United States Patent [19]

Chytil

[11] 4,449,231

[45] May 15, 1984

[54] TEST SIGNAL GENERATOR FOR SIMULATED SPEECH

[75] Inventor: Milan Chytil, Kanata, Canada

[73] Assignee: Northern Telecom Limited, Montreal, Canada

[21] Appl. No.: 305,540

[22] Filed: Sep. 25, 1981

[51] Int. Cl.[3] ..... G10L 1/10

[52] U.S. Cl. ..... 381/51; 331/78; 179/175

[58] Field of Search ..... 331/78; 179/175, 1 SA, 179/1 SC, 1 SM; 364/716, 717; 381/48, 49, 50, 51

[56] References Cited

U.S. PATENT DOCUMENTS

| | | | |
|---|---|---|---|
| 3,746,791 | 7/1973 | Wolf | 179/1 SA |
| 4,187,397 | 2/1980 | Modena et al. | 381/51 |

FOREIGN PATENT DOCUMENTS

| | | | |
|---|---|---|---|
| 30390 | 6/1981 | European Pat. Off. | 179/1 SA |
| 3006339 | 8/1980 | Fed. Rep. of Germany | 179/1 SM |
| 55-34548 | 3/1980 | Japan | 331/78 |
| 160684 | 12/1981 | Japan | 179/1 SC |
| WO79/000892 | 11/1979 | PCT Int'l Appl. | 179/1 SM |

OTHER PUBLICATIONS

Bodley, N., "Here's a Breakthrough-a Low-Cost Speech Synthesizer on a Chip," Electronic Design 15, Jul. 19, 1978, p. 32.

Brantingham, L., "Single Chip LPC Speech Synthesizer and Companion 131kbit ROM," IEEE Transactions on Consumer Electronics, May 1979, vol. CE-25, No. 2, pp. 193-197.

Bryant, H. W., "Comparable Tests on Linear- and Carbon-Type Microphones," Journal of the Acoustic Society of America, 1973, vol. 53, No. 3, pp. 695-698.

Richards, D. L., "Telecommunication by Speech," Butterworth, 1973, pp. 63-69.

*Primary Examiner*—Siegfried H. Grimm
*Assistant Examiner*—W. R. Paxman
*Attorney, Agent, or Firm*—John E. Mowle

[57] ABSTRACT

A test signal generator for pseudo-simulated non-intelligible speech. The generator comprises first and second ROM's controlled by first and second address counters driven by a single clock. The first ROM generates digital samples which when decoded produce a random signal having a gaussian amplitude distribution. The second ROM also generates digital samples which when decoded produce a modulating signal having a power spectrum substantially equal to that of the modulation envelope of speech and a wave shape that results in a gamma amplitude distribution of a gaussian amplitude distributed signal. Each cycle of the modulating signal has an identical wave shape but a randomly varying wave period. The output of the second ROM is demodulated in a first digital-to-analog converter and the demodulated output is used to amplitude modulate the output of the first ROM in a second digital-to-analog converter to provide an output signal which is then passed through a band-shaping filter to provide the pseudo-simulated non-intelligible speech at its output.

3 Claims, 5 Drawing Figures

TEST SIGNAL GENERATOR FOR SIMULATED SPEECH

This invention relates to a generator for producing a signal which approximates the long term average spectrum, instantaneous amplitude distribution, and syllabic structure of speech.

BACKGROUND OF THE INVENTION

Traditionally, the performance evaluation of voice transmission systems in telephony is based on measurements using sinusoidal input signals. Typically, an overall sensitivity/frequency response of a telephone connection (from talker's mouth to listener's ear), either measured directly, or calculated from the responses of the individual parts of the connection, is used to evaluate the loudness level perceived by the listener, the effective bandwidth affecting the intelligibility of transmitted speech, etc. Complex models, based on subjective tests, are then used to combine such attributes of statistically sampled connections to evaluate the effects of introducing new devices into the telephone network in order to maintain or improve grade of service and achieve system economics.

The characterization of a voice transmission system by means of a sinusoidal input signal is strictly valid only for linear systems. However, most telephone connections involve at least one high non-linear element—the carbon microphone. Significant discrepancies are observed on telephone sets with carbon microphones between the expected performance derived from measurements with sinusoidal signals and those experienced in subjective tests using real voice. This is described in a paper entitled "Comparable Tests on Linear- and Carbon-Type Microphones" by H. W. Bryant, *The Journal of the Acoustic Society of America*, Vol. 53, No. 3, 1973, pp 695 to 698. Such discrepancies in expected performance are not nearly as apparent for sets with linear microphones. Additionally, it has been found that close agreement between measured and subjective tests can be realized for non-linear systems if the signal used for their characterization approximates the relevant properties of real voice.

In order to approximate real voice, the traditional single frequency test signal must be replaced by a wideband signal with a power spectrum density similar to that of an average speech signal. If only frequency response measurements of carbon microphones were required, then the exact shaping of the spectrum of such a test signal does not appear to be critical. Quite satisfactory results, i.e. results in agreement with real voice measurements have been obtained using pink noise. However, for wider applications, e.g. for measurements of signa/distortion ratio, this technique does not yield satisfactory results.

STATEMENT OF THE INVENTION

It has been found that an accurate representation of speech may be obtained by first generating a signal with a gaussian amplitude distribution. This signal is then amplitude modulated by a modulating signal having a power spectrum which is substantially equal to that of the modulating characteristics of speech and a wave shape that results in a modulated signal having a gamma amplitude distribution. The modulated signal is then passed through a wave-shaping filter so that the resulting signal will have a power spectrum substantially equal to that of speech. This latter signal will also have an amplitude distribution very similar to that of speech as discussed in the text "Telecommunication By Speech" by D. L. Richards, Butterworth 1973, pp 63–69 at page 65. Using such a technique it is also possible to approximate the typical modulation periodicity, i.e. the syllabic rate, of real speech.

Thus, in accordance with the present invention there is provided a test signal generator for simulated speech, comprising a means for generating a random signal having a gaussian amplitude distribution, as well as a means for generating an amplitude modulating signal having a power spectrum substantially equal to that of the modulated envelope of speech and a wave shape that results in a gamma amplitude distribution of the gaussian signal when modulated thereby. In addition, the generator includes a means for amplitude modulating the gaussian signal by the modulating signal to generate a modulated signal. Also included is a filter means for shaping the modulated signal to approximate the power spectrum of speech.

In a particular embodiment, the gaussian amplitude signal is a pseudo-random signal, and the amplitude modulating signal has a pseudo-random repetition rate which approximates the syllabic repetition rate of speech. Using this signal generator, preliminary measurements of transmitting sensitivity/frequency responses and objective loudness ratings on telephone sets with carbon microphones indicate better agreement with results obtained with real voice than do measurements made using a sinusoidal signal or pink noise. The signal generator may also be used to test automatic gain controllers, voice switching devices, digital codecs, digital attenuator pads, and echo cancellers.

BRIEF DESCRIPTION OF THE DRAWINGS

An example embodiment of the invention will now be described with reference to the accompanying drawings in which.

DESCRIPTION OF THE PREFERRED EMBODIMENT

Figure 1:
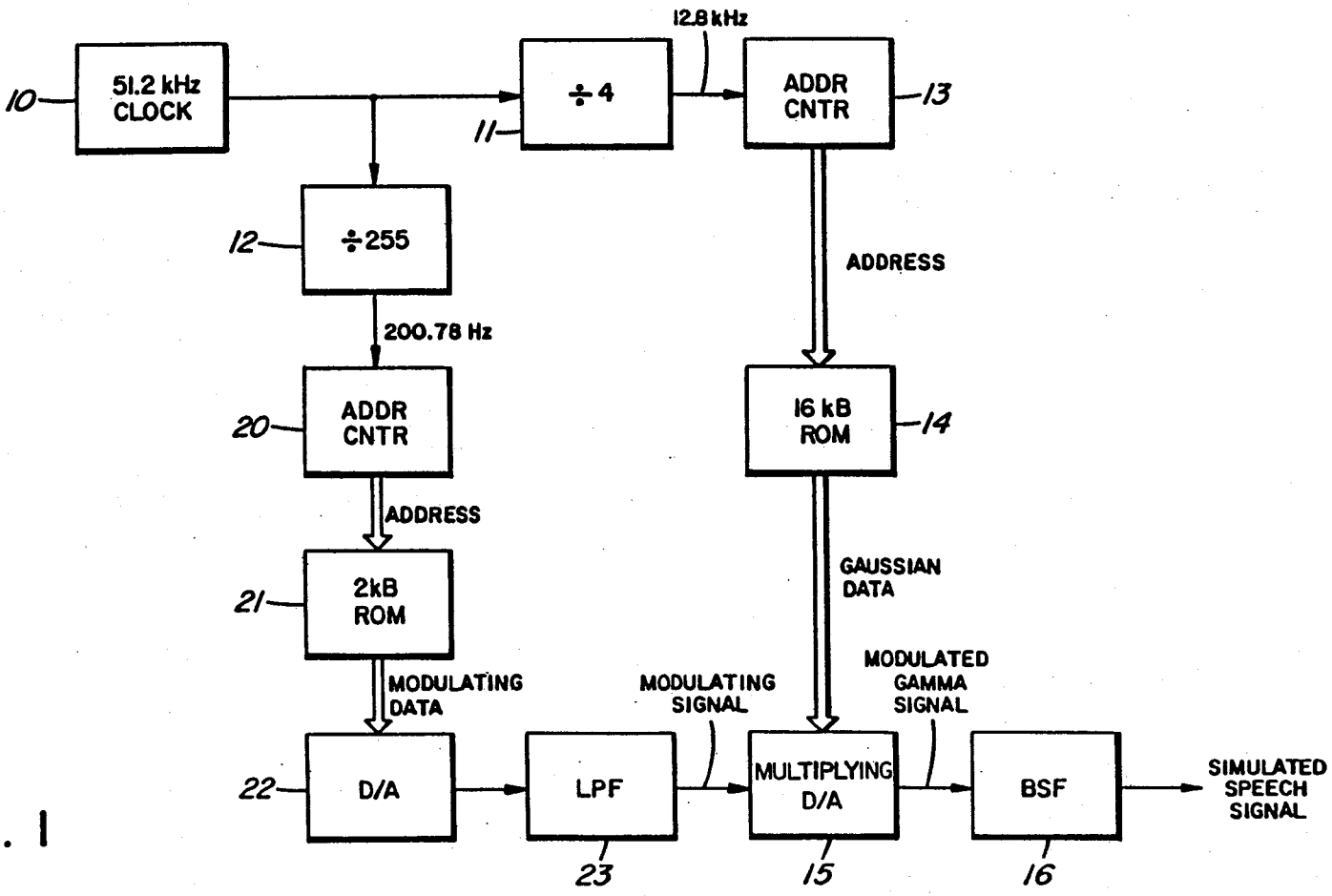
FIG. 1 is a block schematic diagram of a test signal generator for pseudo-simulated speech.

Referring to FIG. 1, the test signal generator for producing pseudo-simulated speech comprises a 51.2 kHz clock 10 the output of which is used to drive a divide-by-4 counter 11 and a divide-by-255 counter 12 to produce a 12.8 kHz clock signal and a 200.78 Hz clock signal respectively. The 12.8 kHz clock signal drives an address counter 13 which repetitively generates a sequence of 16,384 addresses which are fed to a 16 kBit ROM 14 (read-only-memory). The ROM 14 in turn generates 16 different segments each of which has 1,024 bytes, each byte consisting of an 8-bit word. Alternate ones of the 1,024 byte segments have identical gaussian power spectra. However, the phase of the individual frequency components is randomized within and between these 8 alternate segments uniformly from 0° to 360°, in order to randomize the interaction between intermodulation products of the harmonically related spectral components. Each of these 8 alternate segments is interconnected by 8 merging segments during which the power of the previous segment is gradually reduced to zero while the power of the following segment is increased to full amplitude. The simultaneous fade-out of the previous segment and fade-in of the following segment eliminates the transients which would otherwise occur at the segment boundaries. The complete signal sequence thus consists of eight 1,024 byte pseudo-random signal segments interleaved with eight 1,024 byte merging segments for a total of 16,384 bytes.

Figure 2:
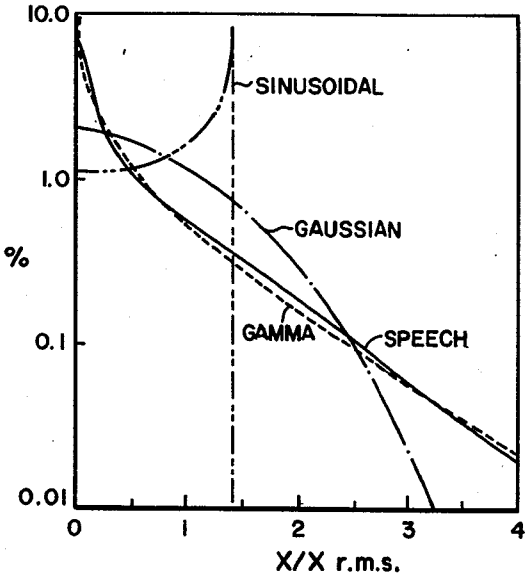
FIG. 2 is a graph of the amplitude distribution of speech and of various other signals (used for testing speech transmission)

The magnitude of each encoded byte stored in the ROM 14 is selected in a known manner, so that the amplitude distribution of the resultant signal when decoded is gaussian as shown in FIG. 2 while its power spectrum is flat over the range of speech signals. Amplitude distribution is the percentage of time that a given signal has an instantaneous amplitude (X) for a particular rms value ($X_{rms}$). The bytes, each consisting of binary 8-bit (1 polarity and 7 magnitude) words are sequentially fed to the digital input of a digital to analog (D/A) converter 15.

Figure 3:
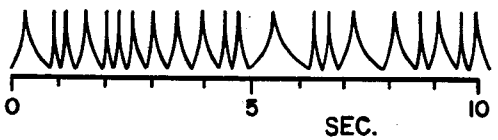
FIG. 3 is a typical voltage waveform of a modulating signal produced by the test signal generator of FIG. 1.

In a like manner, the 200.78 Hz clock signal is used to drive an address counter 20 which repetitively generates a sequence of 2,048 addresses which are fed in parallel to a 2 kBit ROM 21. The ROM 21 in turn generates an empirically derived modulating signal as shown in FIG. 3 having a pseudo-random repetition rate which approximates the syllabic modulation of real speech over the (2048/200.78)=10.2 sec duration of the sequence of the modulating pulses. The waveshape of each cycle of this modulating signal is identical although its period varies in a pseudo-random manner.

Figure 4:
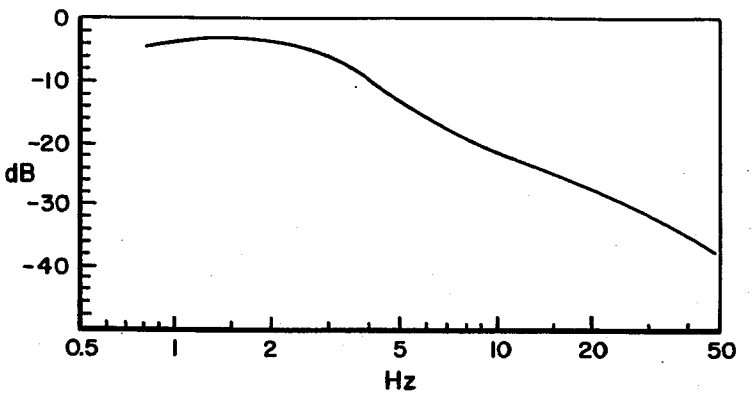
FIG. 4 is the power spectrum of the modulating signal illustrated in FIG. 3.

Again the magnitude of each encoded byte stored in this ROM 21 is empirically selected so that the resultant decoded signal has a waveshape such that when the signal is used to amplitude modulate the gaussian amplitude distributed signal, it results in a modulated signal having a gamma amplitude distribution as shown in FIG. 2. This criteria would in itself not define a unique wave shape. Therefore in addition to this, the power spectrum of the modulating signal is made substantially equal to that of the modulation envelope of speech as shown in FIG. 4 by adjusting the rise/fall time ratio and the pseudo-random variation of periodicity of the modulating pulses. By meeting these two requirements a uniquely defined waveshape for the modulating signal is obtained. It should be noted that each cycle of this signal shown in FIG. 3 has the same wave shape although its period varies pseudo-randomly in order to simulate speech.

The 2,048 bytes, each consisting of 7 binary magnitude bits (no polarity bit is required for the modulating signal), are coupled in parallel to a D/A (digital to analog) converter 22, the output of which is coupled through a low-pass filter 23 to suppress the components above one-half the sampling clock frequency from the modulating signal which is generated during the decoding process. This modulating signal is used to amplitude modulate the gaussian signal in the following manner.

Figure 5:
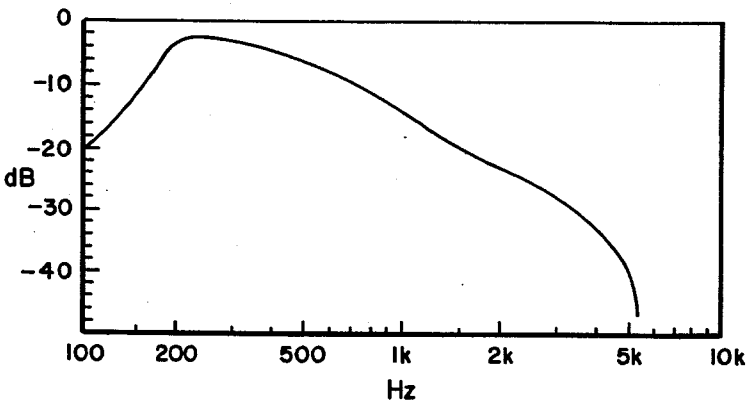
FIG. 5 is the power spectrum of the signal generated by the test signal generator of FIG. 1.

In many commercially available multiplying digital-to-analog converters (e.g. Advanced Micro Devices, Inc; Sunnyvale, Calif., device #AmDAC-08), it is common practice to utilize a reference voltage which establishes the maximum analog signal level for the converted digital sample. By varying this reference voltage, amplitude modulation of the converted digital signal will result. Hence, by utilizing the modulating signal at the output of the low-pass filter 23 as the reference signal, amplitude modulation of the converted gaussian signal at the output of the D/A converter 15 results. Thus, the output signal of the converter 15 is a pseudo-random signal having a gamma amplitude distribution (FIG. 2), a substantially flat power spectrum (covering the speech band) up to a frequency equal to about one-half the 12.8 kHz sample rate of the digital signal from the ROM 14, and a modulation envelope which follows the modulting signal shown in FIG. 3. This flat gamma output signal is then coupled through a band shaping filter 16 which has a frequency response substantially as shown in FIG. 5. This is a typical response curve for the power spectrum of speech for a large number of talkers. The band shaping filter 16 also serves as a low-pass filter to suppress the components of the digital-to-analog converter 15 which exceed one-half the sampling clock frequency. While the low-pass filtering of the digital component must take place after the modulation process, the band shaping of FIG. 5 can be introduced directly into the digital representation of the signal from the ROM 14 rather than in the filter 16. It is important to note that while the filter 16 affects the frequency response of the speech signal, it has no effect on the gamma amplitude distribution as this is relative at any one frequency. A simple analogy can be made to a sine wave signal the amplitude distribution of which is shown in FIG. 2. Such a signal has a particular shape and hence a constant amplitude distribution, regardless of the magnitude or frequency thereof.

Instead of the ROM 14 and the D/A converter 15 a white noise generator (amplified thermal noise, or diode noise) could be used. However, using an analog signal generator might lead to problems with maintaining amplitude stability (variations with temperature, component ageing, etc.). Also the modulation would have to be done by analog means (resulting in problems of stability and linearity). These problems are generally bypassed by generating and modulating the signal by digital means.

If the size of the memory 14 was unlimited, it could be filled with numbers taken at random from a gaussian distribution. With a finite size memory, a truly random signal cannot be generated, since the signal will be periodically repeating. Thus the pseudo-random signal approximates white noise in the sense that the power of every frequency component is uniform (up to about one-half the sampling frequency) and the amplitude distribution is gaussian. The main difference from a white noise is that the power spectrum of a pseudo-random signal is not continuous but discrete (line spectrum), with all the energy concentrated at single frequencies which are integer multiples of the reciprocal of the psuedo-random sequence duration (e.g. for a duration of 1 second the energy is at 1,2,3,4 . . . Hz, for duration of 10 msec the energy is at 100, 200, 300, 400, . . . Hz). Also the phase shift between these individual frequency components of the signal is random, but invariant within the single pseudo-random sequence.

A convenient way of deriving such a signal is by inverse Fourier transform of the desirable frequency spectrum (transformation from frequency domain to time domain), in particular, using the Fast Fourier transform (FFT) algorithm to perform a discrete Fourier transform. For approximation to a white noise, equal magnitude (say, unity) of all discrete frquency components and uniformly random phase within 0 to 360 degrees are specified. The inverse FFT then yields directly the numerical representation of the signal in time and can be stored in the ROM 14. To circumvent the problem of the phase invariance within one single pseudo-random sequence, rather than using one long sequence, 8 shorter ones are used, having the phase randomized between them (the number 8 was obtained empirically as sufficient for this purpose).

The sampling frequency for the gaussian signal is 12800 Hz and for the modulating signal $12800 \times 4/255$, i.e. about 200.78 Hz. The ratio of these two sampling frequencies was chosen to spread the peaks of the modulating signal more evenly over the repeating sequence of the main signal. The repetition times are 1.28 sec for the gaussian signal and 10.2 sec for the modulating signal, thus a repetition of the modulated signal occurs only every 326.4 sec.

What is claimed is:

1. A test signal generator for pseudo-simulated non-intelligible speech, comprising:

means for generating a random signal having a gaussian amplitude distribution;

means for generating a modulating signal having a power spectrum substantially equal to that of the modulation envelope of speech and a wave shape that results in a gamma amplitude distribution of a gaussian amplitude distributed signal, each cycle of the modulating signal having an identical wave shape and a varying wave period;

means for amplitude modulating the signal having a gaussian amplitude distribution by the modulating signal to generate a modulated gamma signal and filter means for shaping the modulated signal to approximate the power spectrum of speech.

2. A test signal generator as defined in claim 1 in which:

the signal having a gaussian amplitude distribution is a pseudo-random signal; and the amplitude modulating signal has a pseudo-random repetition rate which approximates the syllabic repetition rate of speech.

3. A test signal generator as defined in claim 2 in which:

the means for generating a signal having a gaussian amplitude distribution comprises means for generating a digital representation of the gaussian signal having a sampling rate greater than about twice the highest frequency of speech;

the means for generating a modulating signal comprises means for generating a digital representation of the modulating signal having a sampling rate greater than about 100 times said syllabic repetition rate, and a first digital-to-analog converter for converting the digital representation of the modulating signal to a first analog signal;

a second digital-to-analog converter for converting the digital representation of the signal having a gaussian amplitude distribution to a second analog signal;

said second converter utilizing a reference voltage to control the maximum amplitude of the second analog signal; and means for coupling the modulating signal to the second converter to function as the reference signal.

* * * * *